US008740328B2

(12) United States Patent
Terada

(10) Patent No.: US 8,740,328 B2
(45) Date of Patent: Jun. 3, 2014

(54) INKJET PRINTER, GAP DETECTABLE DEVICE, AND A METHOD TO OBTAIN FLUCTUATION OF GAP LEVELS

(71) Applicant: Kohei Terada, Kiyosu (JP)

(72) Inventor: Kohei Terada, Kiyosu (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 13/729,168

(22) Filed: Dec. 28, 2012

(65) Prior Publication Data

US 2013/0257936 A1 Oct. 3, 2013

(30) Foreign Application Priority Data

Mar. 30, 2012 (JP) ..... 2012-082620

(51) Int. Cl.
*B41J 25/308* (2006.01)

(52) U.S. Cl.
USPC ..... 347/8; 347/14; 347/19; 347/104

(58) Field of Classification Search
USPC ..... 347/5, 8, 14, 16, 19, 104
See application file for complete search history.

(56) References Cited

U.S. PATENT DOCUMENTS

| | | | | |
|---|---|---|---|---|
| 6,092,939 | A | 7/2000 | Nishikori et al. | |
| 6,310,637 | B1 | 10/2001 | Shimada et al. | |
| 6,964,476 | B2 * | 11/2005 | Okamoto | 347/104 |
| 2004/0126164 | A1 | 7/2004 | Ohyama | |
| 2005/0168557 | A1 | 8/2005 | Ohyama | |
| 2008/0150978 | A1 | 6/2008 | Sato et al. | |
| 2009/0262157 | A1 | 10/2009 | Sato et al. | |
| 2011/0175958 | A1 | 7/2011 | Sato et al. | |

FOREIGN PATENT DOCUMENTS

| | | | |
|---|---|---|---|
| EP | 0622227 | A2 | 4/1994 |
| JP | 2003-54078 | A | 2/2003 |
| JP | 2004-17586 | A | 1/2004 |
| JP | 2004-106978 | A | 4/2004 |
| JP | 3554184 | B2 | 8/2004 |
| JP | 2006-192814 | A | 7/2006 |
| JP | 2007-25492 | A | 2/2007 |
| JP | 2008-155423 | A | 7/2008 |
| JP | 2008-155424 | A | 7/2008 |
| JP | 2009-23121 | A | 2/2009 |
| JP | 2009-143152 | A | 7/2009 |
| JP | 2009-202430 | A | 9/2009 |

OTHER PUBLICATIONS

Extended European Search Report dated Jul. 9, 2013 from related EP 12199742.3.

* cited by examiner

*Primary Examiner* — Juanita D Jackson
(74) *Attorney, Agent, or Firm* — Scully, Scott, Murphy & Presser, PC

(57) ABSTRACT

An inkjet printer including an inkjet head with an ink discharging surface, a head scanning unit to drive the inkjet head to reciprocate along a first direction, and a pattern-printing control device to control printing a gap level pattern on a recording medium, is provided. The pattern-printing control device controls the inkjet head and the head scanning unit to print the gap level pattern including a plurality of unit patterns, in each of which the first linear pattern and the second linear pattern intersect each other, aligned along the first direction by manipulating the inkjet head to form a plurality of first linear patterns, which are formed to intersect the first direction, along the first direction, and to form a plurality of second linear patterns, which are formed to intersect the first linear patterns respectively at a same angle, along the first direction.

14 Claims, 10 Drawing Sheets

INKJET PRINTER, GAP DETECTABLE DEVICE, AND A METHOD TO OBTAIN FLUCTUATION OF GAP LEVELS

CROSS REFERENCE TO RELATED APPLICATION

This application claims priority from Japanese Patent Application No. 2012-082620, filed on Mar. 30, 2012, the entire subject matter of which is incorporated herein by reference.

BACKGROUND

1. Technical Field

The following description relates to an inkjet printer for printing an image by ejecting ink from nozzles, a gap detecting device capable of detecting fluctuation of levels of a gap between an ink discharging surface of the inkjet printer and a recording medium, and a method to obtain the fluctuation of the gap levels.

2. Related Art

As an example of inkjet printers configured to perform printing by discharging ink from nozzles onto a recording medium, an inkjet printer has been known that is configured to perform printing by discharging ink onto a recording sheet (a recording medium) from a recording head (an inkjet head) mounted on a carriage reciprocating along a predetermined reciprocating direction. Further, the known inkjet printer is configured to cause a feed rollers or corrugated holding spur wheels to press the recording sheet against a surface of a platen that has thereon convex portions and concave portions alternately formed along the reciprocating direction, so as to deform the recording sheet in a predetermined wave shape. The predetermined wave shape has mountain portions, which protrude toward an ink discharging surface of the recording head, and valley portions, which are recessed in a direction opposite to the direction toward the ink discharging surface side, alternately arranged along the reciprocating direction.

SUMMARY

In the known inkjet printer, levels (amounts) of the gap between the ink discharging surface of the recording head and the recording sheet vary depending on portions (locations) on the recording sheet deformed in the wave shape (hereinafter, which may be referred to as a "wave-shaped recording sheet"). Therefore, when the known inkjet printer performs printing by discharging ink from the recording head onto the wave-shaped recording sheet with the same ink discharging timing as when performing printing on a recording sheet not deformed in such a wave shape, an ink droplet might land in a position deviated from a desired position on the recording sheet. Thus, it might result in a low-quality printed image. Further, in this case, the positional deviation value with respect to the ink landing position on the recording sheet varies depending on the portions (locations) on the recording sheet.

In view of the above problem, for instance, the following method is considered as a measure for discharging an ink droplet in a desired position on the wave-shaped recording sheet. The method is to adjust ink discharging timing (a moment) to discharge an ink droplet from the inkjet head depending on an amount of the gap between the ink discharging surface of the inkjet head and each individual one of (tops of) the mountain portions and (bottoms of) the valley portions formed on the recording sheet. Further, in order to adjust the ink discharging timing, it is required to detect amounts of the gap between the ink discharging surface of the inkjet head and each individual one of (the tops of) the mountain portions and (the bottoms of) the valley portions on the recording sheet.

Aspects of the present invention are advantageous in that an inkjet printer, a gap detecting device, and a method to obtain fluctuation of the gap amount between the ink discharging surface and the recording medium are provided.

According to aspects of the present invention, an inkjet printer including an inkjet head configured to discharge ink droplets from nozzles formed in an ink discharging surface thereof; a head scanning unit configured to move the inkjet head facing a recording medium to reciprocate along a first direction, the first direction being parallel with the ink discharging surface of the inkjet head; and a pattern-printing control device configured to control the inkjet head and the head scanning unit to print a gap level pattern, which is configured to exhibit fluctuation of levels of a gap between the ink discharging surface and the recording medium along the first direction to be detectable, on the recording medium; is provided. The pattern-printing control device controls the inkjet head and the head scanning unit to print the gap level pattern including a plurality of unit patterns, in each of which a first linear pattern and a second linear pattern intersect each other, aligned along the first direction, by manipulating the inkjet head to move in a first orientation along the first direction and to discharge the ink from the plurality of nozzles to form a plurality of first linear patterns, which are formed to intersect the first direction, along the first direction while being moved; and manipulating the inkjet head to move in a second orientation along the first direction and to discharge the ink from the plurality of nozzles to form a plurality of second linear patterns, which are formed to intersect the first linear patterns respectively at a same angle, along the first direction while being moved.

According to aspects of the present invention, a method to obtain fluctuation of levels of a gap between an inkjet head and a recording medium along a first direction in an inkjet printer, which includes an inkjet head configured to discharge ink droplets from nozzles formed in an ink discharging surface thereof and a head driving unit configured to hold the inkjet head in an opposing position from the recording medium and to drive the inkjet head to reciprocate along a first direction, the first direction being parallel with the ink discharging surface of the inkjet head, is provided. The method includes steps of printing a gap level pattern, which is configured to exhibit fluctuation of levels of a gap between the ink discharging surface and the recording medium along the first direction to be detectable, on the recording medium; reading the gap level pattern printed on the recording medium; and obtaining fluctuation of the levels of the gap along the first direction from the gap level pattern read in the step of reading. In the step of printing, the gap level pattern including a plurality of unit patterns, in each of which a first linear pattern and a second linear pattern intersect each other, aligned along the first direction, is printed by manipulating the inkjet head to move in a first orientation along the first direction and to discharge the ink from the plurality of nozzles to form a plurality of first linear patterns, which are formed to intersect the first direction, along the first direction while being moved; and manipulating the inkjet head to move in a second orientation along the first direction and to discharge the ink from the plurality of nozzles to form a plurality of second linear patterns, which are formed to intersect the first linear patterns respectively at a same angle, along the first direction while being moved. In the step of obtaining, the fluctuation of levels of the gap between the ink discharging surface and the recording medium along the first direction is obtained by detecting the levels of the gap between the ink discharging surface and an area on the recording medium, in which the unit patterns in the gap level pattern are formed, based on positions of intersections, in which the second linear patterns intersect the first linear patterns within the respective unit patterns, along a second direction being orthogonal to the first direction.

According to aspects of the present invention, a gap detectable device configured to detect fluctuation of levels of a gap between an inkjet discharging surface of an inkjet head and a recording medium along a first direction in an inkjet printer is provided. The gap detectable device includes a reading unit configured to read a predetermined gap level pattern, which is printed in the inkjet printer on the recording medium and includes a plurality of unit patterns aligned along the first direction, each of the unit patterns including a first linear pattern formed along the first direction and a second linear pattern formed along the first direction to intersect the first linear pattern at an angle; and a gap level obtaining device configured to obtain the fluctuation of levels of the gap between the ink discharging surface and the recording medium along the first direction by detecting the levels of the gap between the ink discharging surface and an area on the recording medium, in which the unit patterns in the gap level pattern are formed, based on positions of intersections, in which the second linear patterns intersect the first linear patterns within the respective unit patterns, along a second direction being orthogonal to the first direction.

BRIEF DESCRIPTION OF THE ACCOMPANYING DRAWINGS

Figure 1:
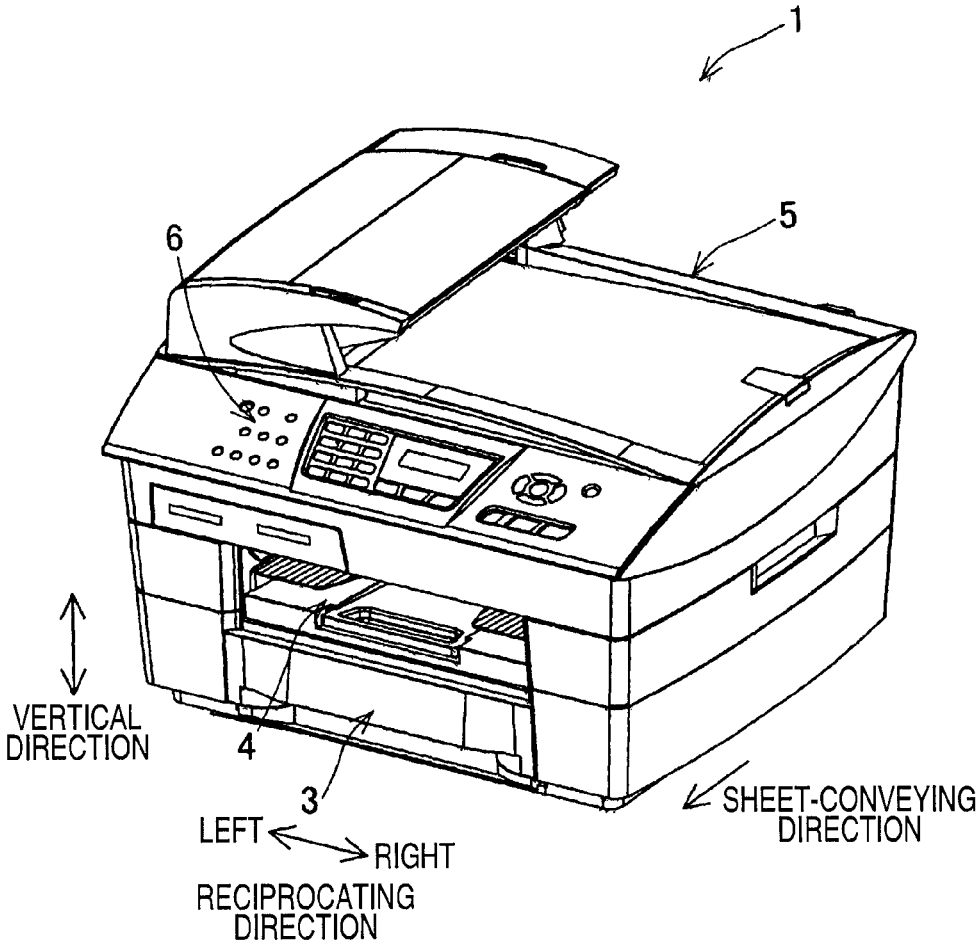
FIG. 1 is a perspective view schematically showing a configuration of an inkjet printer in an embodiment according to one or more aspects of the present invention.
Figure 2:
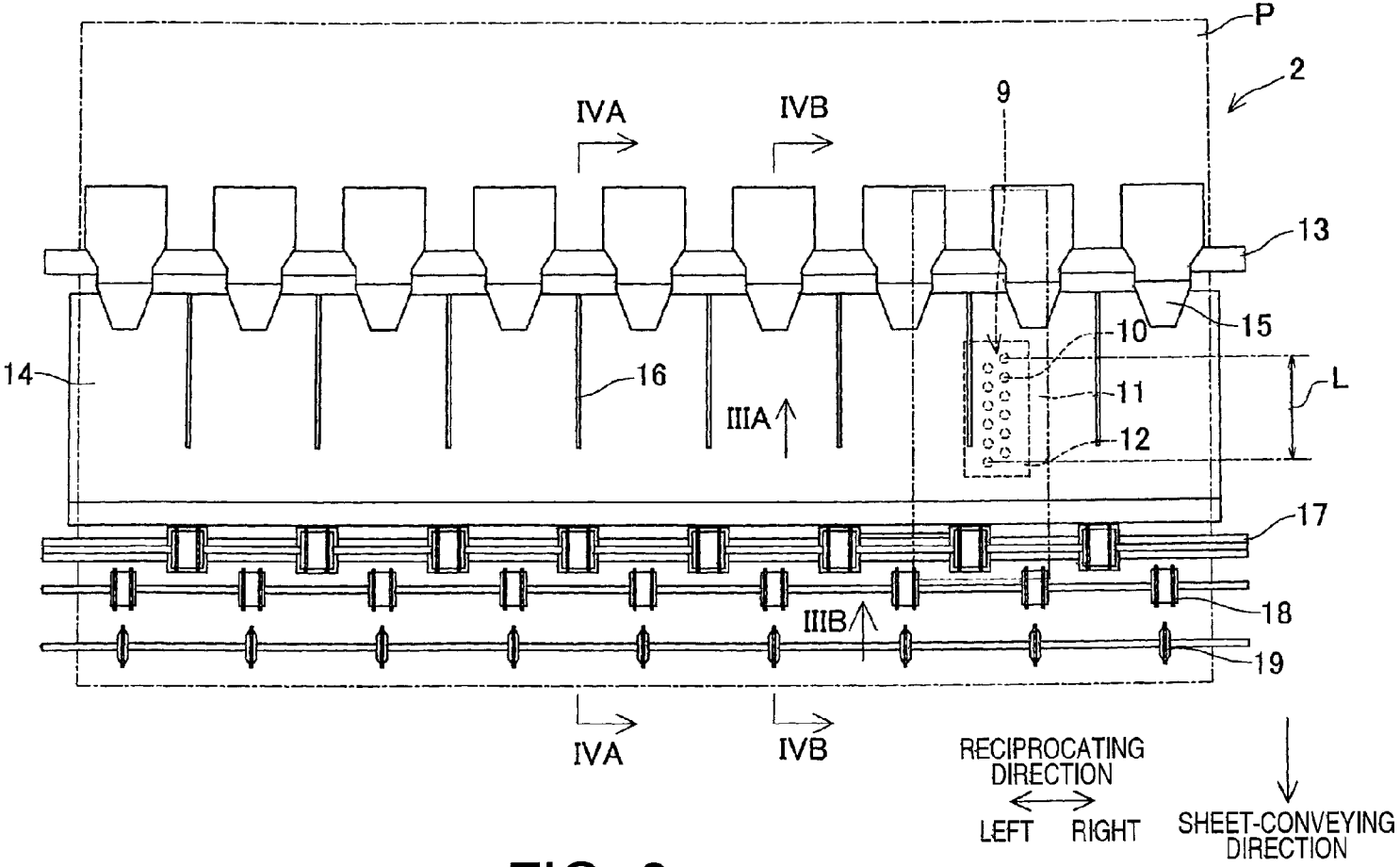
FIG. 2 is a top view of a printing unit of the inkjet printer in the embodiment according to one or more aspects of the present invention.
Figure 3A:
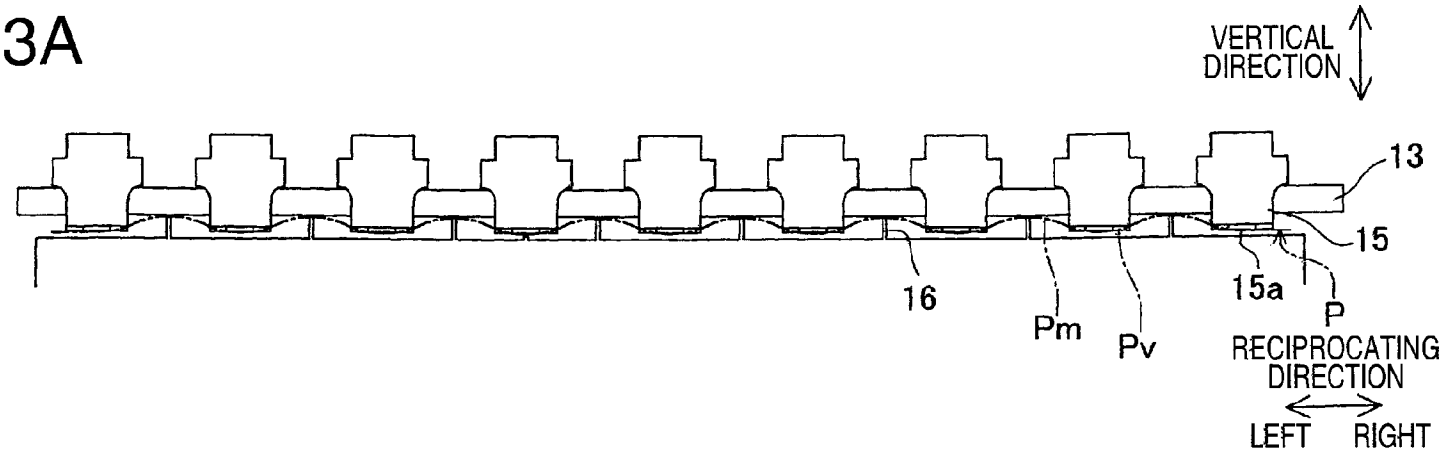

FIG. 3A schematically shows a part of the printing unit when viewed along an arrow IIIA shown in FIG. 2 in the embodiment according to one or more aspects of the present invention.

Figure 3B:
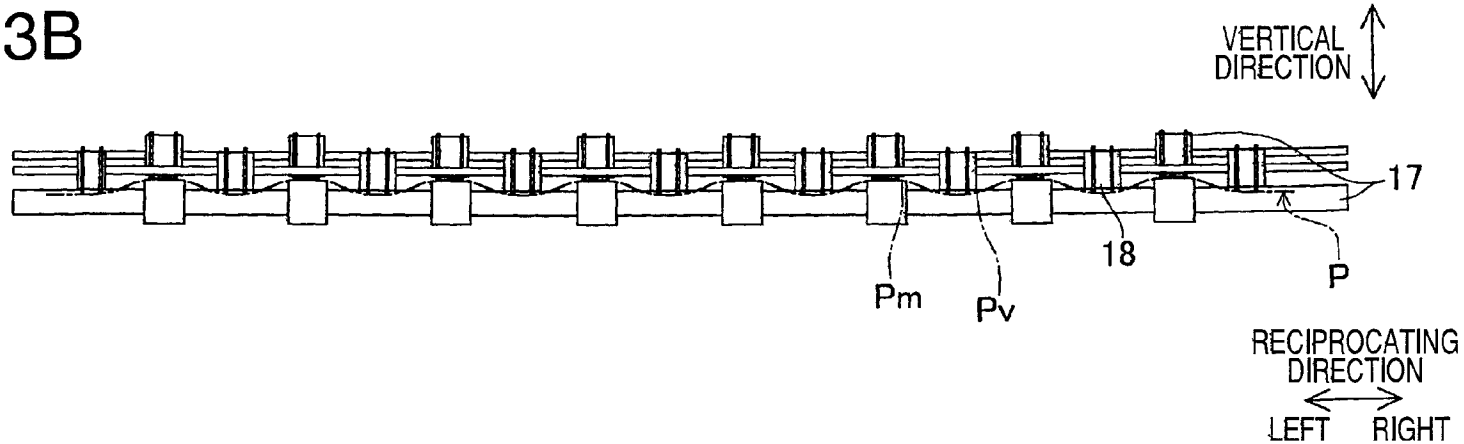

FIG. 3B schematically shows a part of the printing unit when viewed along an arrow IIIB shown in FIG. 2 in the embodiment according to one or more aspects of the present invention.

Figure 4A:
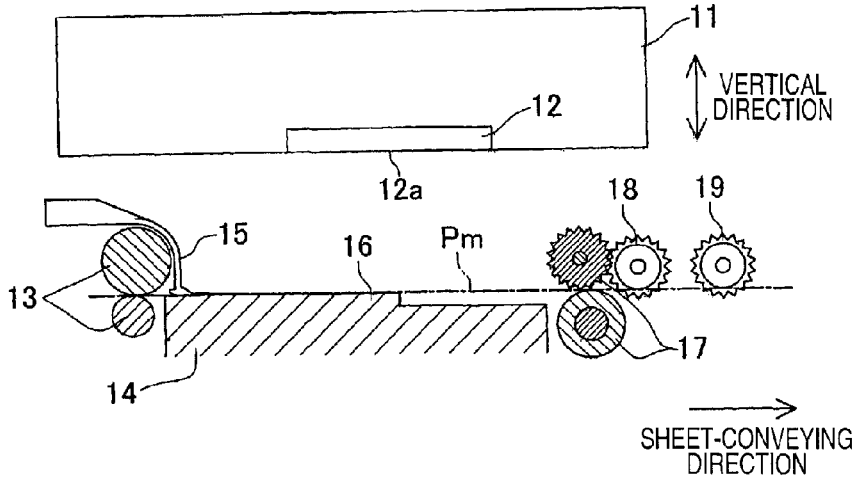

FIG. 4A is a cross-sectional view taken along a line IVA-IVA shown in FIG. 2 in the embodiment according to one or more aspects of the present invention.

Figure 4B:
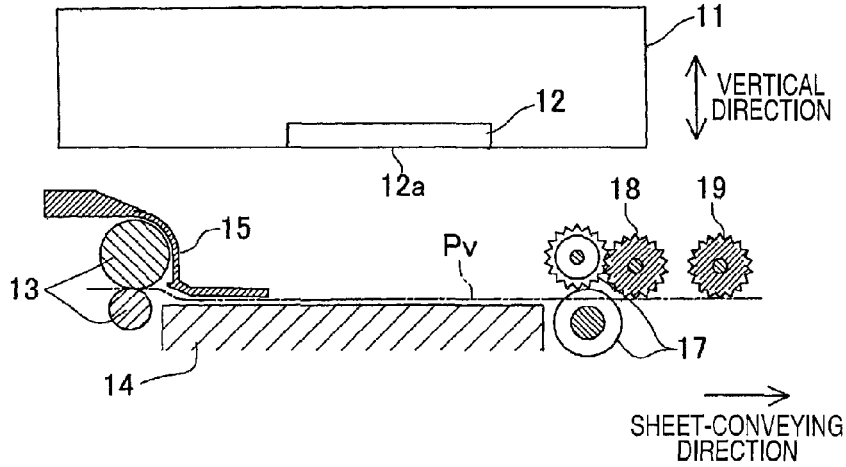

FIG. 4B is a cross-sectional view taken along a line IVB-IVB shown in FIG. 2 in the embodiment according to one or more aspects of the present invention.

Figure 5:
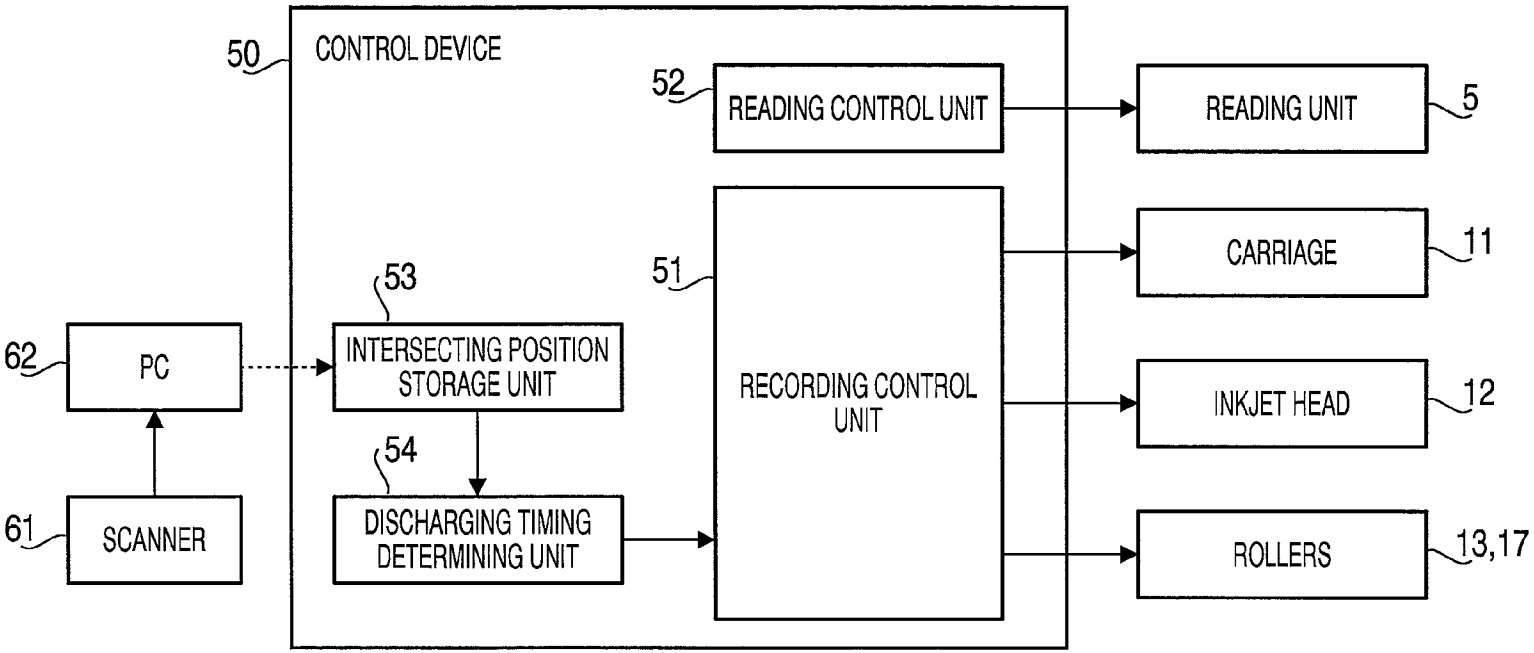

FIG. 5 is a functional block diagram of a control device of the inkjet printer in the embodiment according to one or more aspects of the present invention.

Figure 6:
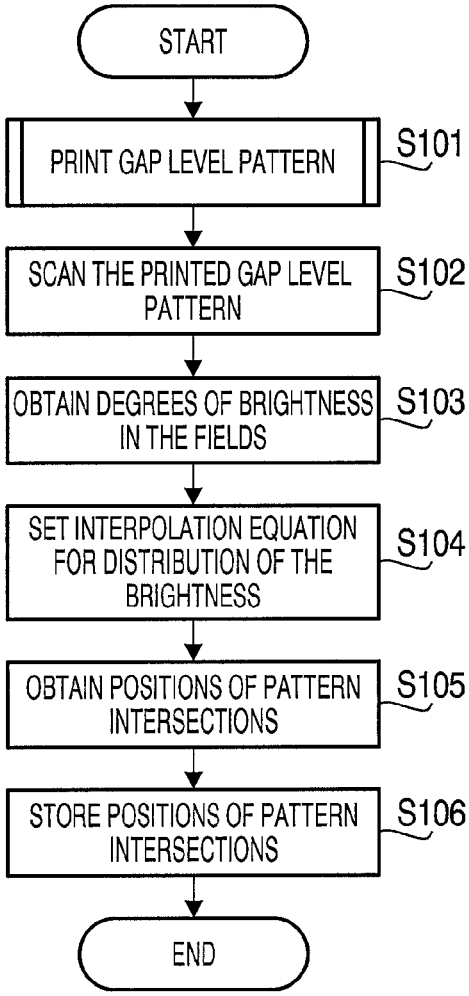

FIG. 6 is a flowchart to illustrate a process to detect levels of a gap between an ink discharging surface and a recording sheet in the inkjet printer in the embodiment according to one or more aspects of the present invention.

Figure 7:
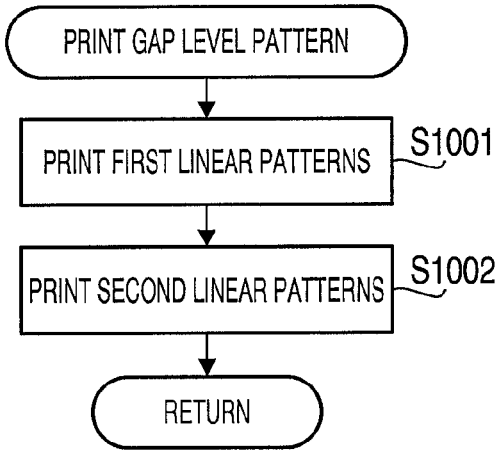

FIG. 7 is a flowchart to illustrate a process to print a gap level pattern in the inkjet printer in the embodiment according to one or more aspects of the present invention.

Figure 8A:
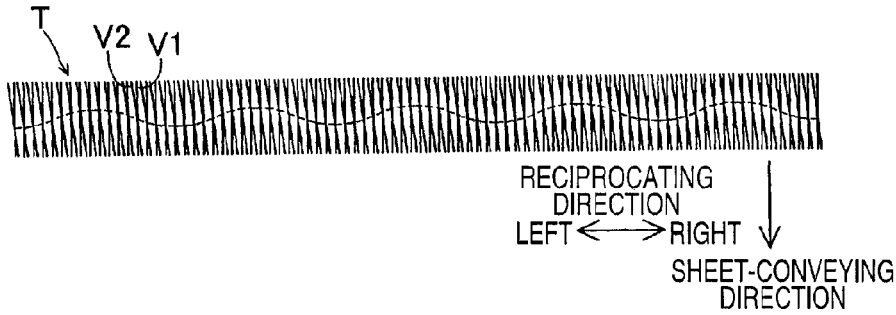

FIG. 8A illustrates appearance of the gap level pattern printed in the inkjet printer in the embodiment according to one or more aspects of the present invention.

Figure 8B:
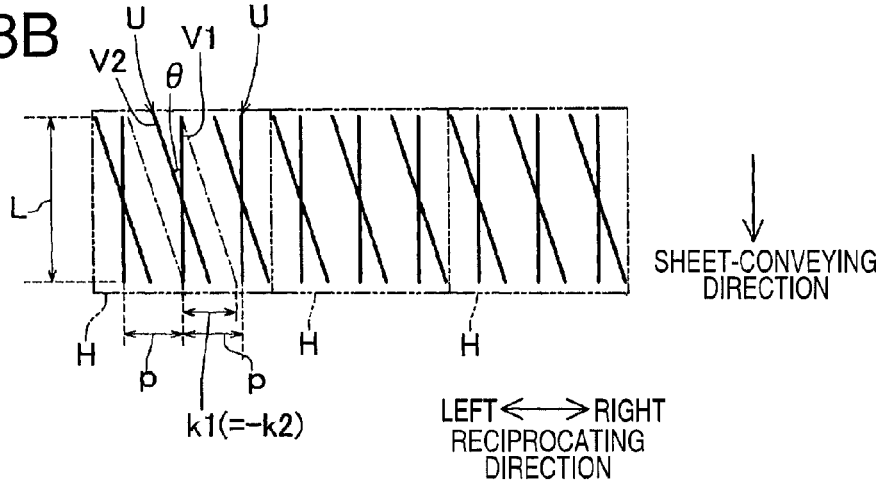

FIG. 8B is an enlarged partial view of the gap level pattern printed in the inkjet printer in the embodiment according to one or more aspects of the present invention.

Figure 8C:
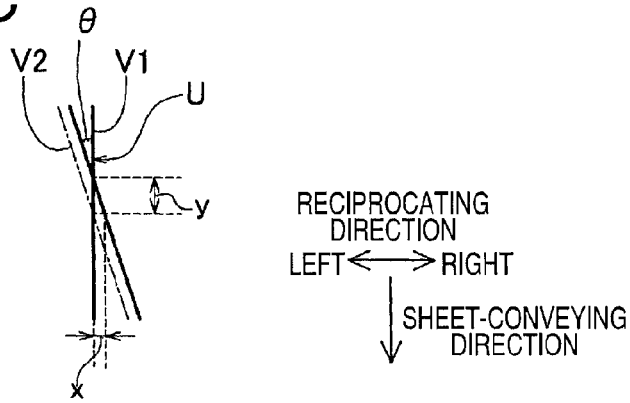

FIG. 8C illustrates displacement of a pattern intersection in the gap level pattern printed in the inkjet printer in the embodiment according to one or more aspects of the present invention.

Figure 9A:
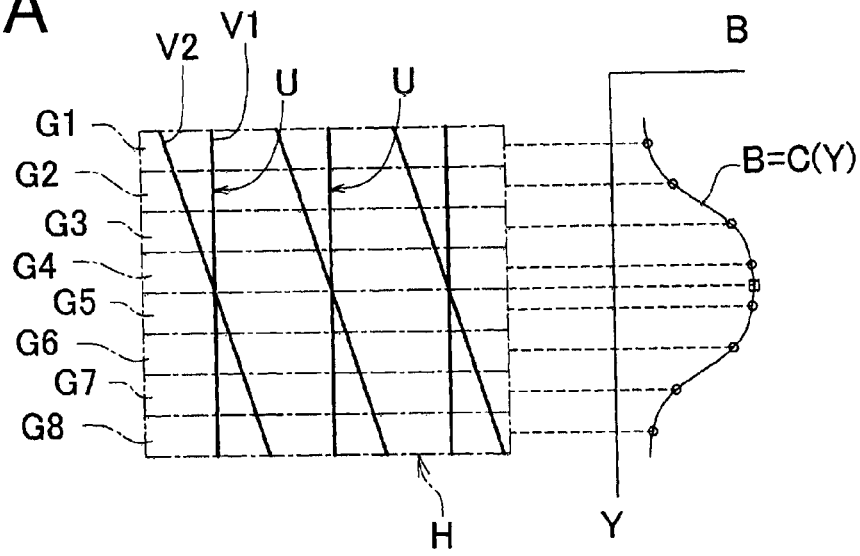

FIG. 9A illustrates divided detectable divisions and distribution of brightness in the gap level pattern printed in the inkjet printer in the embodiment according to one or more aspects of the present invention.

Figure 9B:
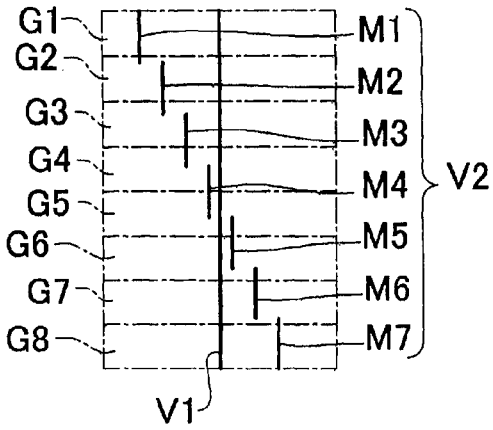

FIG. 9B illustrates an enlarged view of a unit pattern in the gap level pattern printed in the inkjet printer in the embodiment according to one or more aspects of the present invention.

Figure 10A:
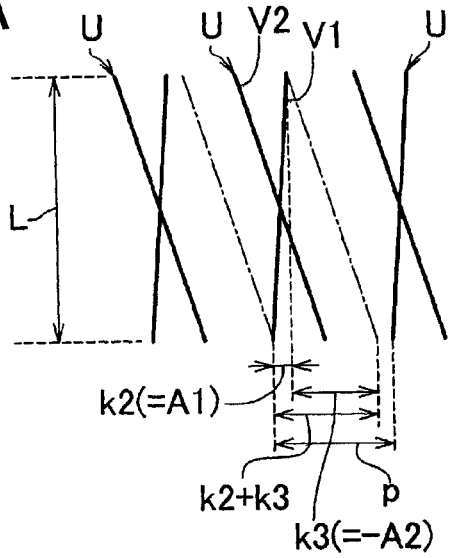

FIG. 10A illustrates an enlarged partial view of the gap level pattern in the inkjet printer in a first modified example according to one or more aspects of the present invention.

Figure 10B:
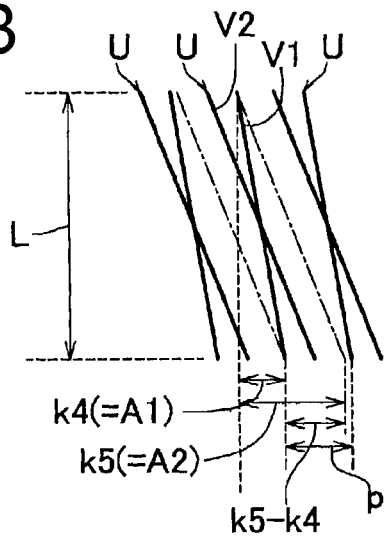

FIG. 10B illustrates an enlarged partial view of the gap level pattern in the inkjet printer in a second modified example according to one or more aspects of the present invention.

Figure 11:
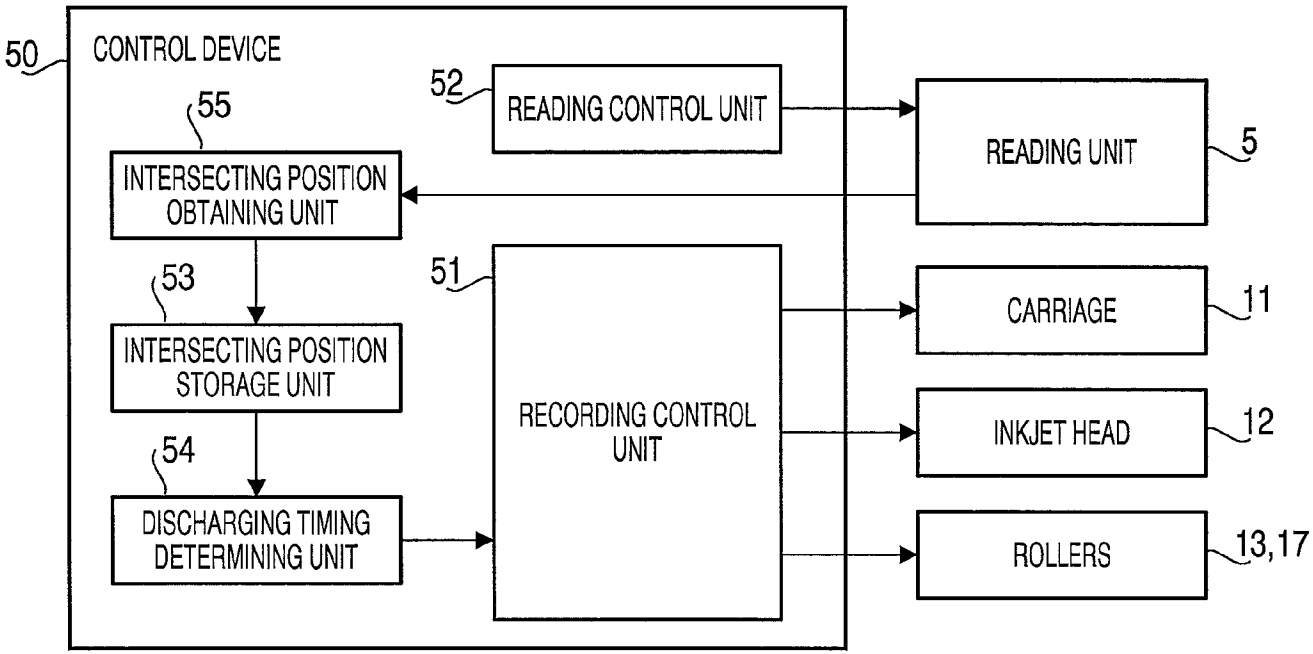

FIG. 11 is a functional block diagram of the control device of the inkjet printer in a third modified example according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, embodiments according to aspects of the present invention will be described in detail with reference to the accompanying drawings.

An inkjet printer 1 of the embodiment is a multi-function peripheral having a plurality of functions such as a printing function to perform printing on a recording sheet P and an image reading function. The inkjet printer 1 includes a printing unit 2 (see FIG. 2), a sheet feeding unit 3, a sheet ejecting unit 4, a reading unit 5, an operation panel 6. Further, the inkjet printer 1 includes a control device 50 configured to control operations of the inkjet printer 1 (see FIG. 5).

The printing unit 2 is provided inside the inkjet printer 1. The printing unit 2 is configured to perform printing on the recording sheet P. The sheet feeding unit 3 is configured to feed the recording sheet P to be printed by the printing unit 2. The sheet ejecting unit 4 is configured to eject the recording sheet P with an image printed thereon by the printing unit 2. The reading unit 5 is configured to be, for instance, an image scanner for reading images. The operation panel 6 is provided with buttons and a liquid crystal display. A user is allowed to manipulate the inkjet printer 1 via the buttons of the operation panel 6.

Subsequently, the printing unit 2 will be described. As shown in FIGS. 2 to 4, the printing unit 2 includes a carriage 11, an inkjet head 12, a feed roller 13, a platen 14, a plurality of corrugated plates 15, a plurality of ribs 16, an ejection roller 17, and a plurality of corrugated spur wheels 18 and 19.

It is noted that, for the sake of easy visual understanding in FIG. 2, the carriage 11 is indicated by a dash-and-two-dots line, and portions disposed below the carriage 11 are indicated by solid lines.

The carriage 11 is configured to reciprocate on a guiderail (not shown) along a predetermined reciprocating direction. The inkjet head 12 is mounted on the carriage 11 to be driven along with the carriage 11. The inkjet head 12 is supported on the carriage 11 to face the recording sheet P. The inkjet head 12 is configured to discharge ink from a plurality of nozzles 10 formed in an ink discharging surface 12*a* that is a lower surface of the inkjet head 12. The plurality of nozzles 10 are arranged alternately along a sheet-conveying direction, which is orthogonal to the reciprocating direction, to form nozzle lines 9.

The feed roller 13 includes two rollers configured to pinch therebetween the recording sheet P fed by the sheet feeding unit 3 and feed the recording sheet P in the sheet-conveying direction perpendicular to the reciprocating direction. The platen 14 is disposed to face the ink discharging surface 12*a*. The recording sheet P is fed by the feed roller 13, along an upper surface of the platen 14.

The plurality of corrugated plates 15 are disposed to face an upper surface of an upstream end of the platen 14 along the sheet-conveying direction. The plurality of corrugated plates 15 are arranged at substantially even intervals along the reciprocating direction. The recording sheet P, fed by the feed roller 13, passes between the platen 14 and the corrugated plates 15. At this time, pressing surfaces 15*a*, which are lower surfaces of the plurality of corrugated plates 15, press the recording sheet P from above.

Each of the plurality of ribs 16 is disposed between a corresponding two of mutually adjacent corrugated plates 15 along the reciprocating direction, on the upper surface of the platen 14. The plurality of ribs 16 are arranged at substantially even intervals along the reciprocating direction. Each rib 16 protrudes from the upper surface of the platen 14 up to a level higher than the pressing surfaces 15*a* of the corrugated plates 15. Each rib 16 extends from an upstream end of the platen 14 toward a downstream side along the sheet-conveying direction. Thereby, the recording sheet P on the platen 14 is supported from underneath by the plurality of ribs 16.

The ejection roller 17 includes two rollers configured to pinch therebetween portions of the recording sheet P that are located in the same positions as the plurality of ribs 16 along the reciprocating direction and feed the recording sheet P toward the sheet ejecting unit 4. An upper one of the ejection rollers 17 is provided with spur wheels so as to prevent the ink attached onto the recording sheet P from being transferred to the upper ejection roller 17.

The plurality of corrugated spur wheels 18 are disposed substantially in the same positions as the corrugated plates 15 along the reciprocating direction, at a downstream side relative to the ejection rollers 17 along the sheet-conveying direction. The plurality of corrugated spur wheels 19 are disposed substantially in the same positions as the corrugated plates 15 along the reciprocating direction, at a downstream side relative to the corrugated spur wheels 18 in the sheet-conveying direction. In addition, the plurality of corrugated spur wheels 18 and 19 are placed at a level lower than a position where the ejection rollers 17 pinch the recording sheet P therebetween, along the vertical direction. The plurality of corrugated spur wheels 18 and 19 are configured to press the recording sheet P from above at the level. Further, the plurality of corrugated spur wheels 18 and 19 are not rollers having a smooth outer circumferential surface but a spur wheel. Therefore, it is possible to prevent the ink attached onto the recording sheet P from being transferred to the plurality of corrugated spur wheels 18 and 19.

Thus, the recording sheet P on the platen 14 is pressed from above by the plurality of corrugated plates 15 and the plurality of corrugated spur wheels 18 and 19, and is supported from below by the plurality of ribs 16. Thereby, as shown in FIG. 3, the recording sheet P on the platen 14 is bent and deformed in such a wave shape that mountain portions Pm with tops protruding upward (i.e., toward the ink discharging surface 12*a*) and valley portions Pv with bottoms recessed downward (i.e., in a direction opposite to the direction toward the ink discharging surface 12*a*) are alternately arranged. The top of the mountain portion Pm is the highest position within the mountain portion Pm, while the bottom of the valley portion Pv is the lowest position in the valley portion Pv.

The printing unit 2 configured as above performs printing on the recording sheet P by discharging ink from the inkjet head 12 reciprocating together with the carriage 11 along the reciprocating direction, while conveying the recording sheet P in the sheet-conveying direction by the feed rollers 13 and the ejection rollers 17.

Next, an explanation will be provided about the control device 50 for controlling the operations of the inkjet printer 1. The control device 50 includes a central processing unit (CPU), a read only memory (ROM), a random access memory (RAM), and control circuits. The control device 50 is configured to function as various elements such as a recording control unit 51, a reading control unit 52, an intersecting position storage unit 53, and a discharging timing determining unit 54 (see FIG. 5).

The recording control unit 51 controls behaviors of the carriage 11, the inkjet head 12, the feed roller 13, and the ejection roller 17 when an image including a gap level pattern, which will be described later in detail, is printed. The reading controller 52 controls behaviors of the reading unit 5 when an image appearing on a sheet is read.

An intersecting position storage unit 53 stores information concerning positions of pattern intersections, which are formed in a plurality of areas on the recording sheet P, along the sheet-conveying direction. The positions of pattern intersections, which will be described later in detail, show fluctuation of levels of the gap between the ink discharging 12*a* and the recording sheet P along the reciprocating direction. An ejection timing determining unit 54 determines timings, on which the inkjet head 12 should eject ink from the nozzles 10 toward each area in the recording sheet P, based on the amounts of displacement in the positions of pattern intersections stored in the intersecting position storage unit 53.

Next, a method to detect and obtain fluctuation of levels of the gap between the ink discharging surface 12*a* and the recording sheet P in the inkjet printer 1 will be described. As has been described above, when used in the inkjet printer 1, the recording sheet P is set in the wave shape along the reciprocating direction of the inkjet head 12; therefore, levels of the gap created in between the ink discharging surface 12*a* and the recording sheet P fluctuate depending on positions along the reciprocating direction in the recording sheet P. In order to effectively deal with the fluctuation of the gap levels, and it is necessary that the fluctuation of the gap levels is detected and obtained. The fluctuation of the gap levels may be detected and obtained, for example, within a process of manufacturing, before the inkjet printer 1 is used for the first time by a user to print an image, following a flow of steps shown in FIG. 6.

In order to detect and obtain the fluctuation of the gap levels along the reciprocating direction, as shown in FIG. 6, in S101, firstly, the inkjet printer 1 prints the gap level pattern T on the recording sheet P under control of the recording control unit 51.

More specifically, the flow proceeds to S1001 shown in FIG. 7. In S1001, the carriage 11 with the inkjet head 12 is manipulated to move in one orientation (e.g., rightward) along the reciprocating direction, and the inkjet head 12 is manipulated to discharge the ink from the nozzles 10 while being moved. In particular, as shown in FIG. 8A-8C, the ink is discharged to form a plurality of first linear patterns V1, which extend in parallel with one another along the sheet-conveying direction and align at equally spaced-apart interval along the reciprocating direction.

When the inkjet head 12 is moved to a right-side end of a predetermined printable range of the recording sheet P along the reciprocating direction, in S1002, the carriage 11 is manipulated to move in the other orientation (e.g., leftward) along the reciprocating direction, and the inkjet head 12 is manipulated to form a plurality of second linear patterns V2, which extend in parallel with one another and align at equally spaced-apart interval along the reciprocating direction. Each of the second linear patterns V2 is drawn to incline with respect to the sheet-conveying direction to be closer to the right-hand side of the recording sheet P, as the second linear pattern V2 extends toward a downstream side along the sheet-conveying direction, and intersects one of the first linear patterns V1. Through S1001-S1002, a plurality of unit patterns U, each of which consists of a first linear pattern V1 and a second linear pattern V2 intersecting the first linear pattern V1, are printed on the recording sheet P to align along the reciprocating direction. The flow returns to S101 in FIG. 6.

Thus, in S101, a gap level pattern T, in which the plurality of unit patterns U align along the reciprocating direction, is printed on the recording sheet P.

In S101, in the present embodiment, the control device 50 controls the inkjet head 12 to discharge the ink from the nozzles 10 at discharging timings, in which the first linear patterns V1 and the second linear patterns V2 should intersect each other at their respective midpoints on a virtual recording sheet Pi. The virtual recording sheet P1 is assumed to spread on a virtual plane at a height of an average gap between the ink discharging surface 12*a* and each level of the wave-shaped recording sheet P. In the following description, the positions of the first and second linear patterns V1, V2 on the virtual plane of the recording sheet Pi will be referred to as ideal positions. In the ideal positions, an interval p between two neighboring unit patterns U adjoining along the reciprocating direction is greater than a length (distance) k1 between two ends of the second linear pattern V2 along the reciprocating direction (p >k1).

In the present embodiment, a difference between positions of the two ends of the first linear pattern V1 along the reciprocating direction, in other words, a difference (length) between two ends of the first linear pattern V1 along the reciprocating direction within a coexisting range of the first and second linear patterns V1, V2 will be referred to as a first inclination A1. The coexisting range is a range, which is occupied by the first linear pattern V1 and the second linear pattern V2 to coexist concurrently along the sheet-conveying direction. The difference between the two ends of the first linear pattern V1 is obtained by subtracting a coordinate of a downstream end of the first linear pattern V1 along the sheet-conveying direction from a coordinate of an upstream end of the first linear pattern V1 along the sheet-conveying direction. In this respect, the right-hand side of the unit pattern U along the reciprocating direction indicates positive, and the left-hand side indicates negative. Further, a difference between positions of the two ends of the second linear pattern V2 along the reciprocating direction, in other words, a difference (length) between two ends of the second linear pattern V2 along the reciprocating direction within the coexisting range, which is occupied by the first linear pattern V1 and the second linear pattern V2 concurrently along the sheet-conveying direction, will be referred to as a second inclination A2. The difference is obtained by subtracting a coordinate of a downstream end of the second linear pattern V2 along the sheet-conveying direction from a coordinate of an upstream end of the second linear pattern V2 along the sheet-conveying direction.

In the present embodiment, the first linear pattern V1 extends in parallel with the sheet-conveying direction; therefore, the first inclination A1 is zero (A1=0). Meanwhile, the second linear pattern V2 extends to incline with respect to the sheet-conveying direction to be closer to the right-hand (positive) side of the recording sheet P, as the second linear pattern V2 extends toward the downstream side along the sheet-conveying direction. Therefore, the second inclination A2 is −k1 (A2=−k1). Accordingly, when the interval p is greater than the distance k1 (p>k1), p is greater than an absolute value of the second inclination A2 subtracted from the first inclination A1 (p>|A1−A2|).

In this regard, if the first and the second linear patterns V1, V2 are formed in ink droplets discharged from all of the nozzles 10 in the inkjet head 12, a distance between the upstream and downstream ends of the first and the second linear patterns V1, V2 along the sheet-conveying direction within the coexisting range corresponds to a length L of nozzle lines 9 along the sheet-conveying direction. Therefore, when the second linear pattern V2 intersects the first linear pattern V1 at an angle θ, k1 is equal to L tan θ. Further, while the interval p is larger than the distance k1 (p>k1), p is greater than L tan θ (p>L tan θ).

The positional relation described above is based on the gap of the average height between the ink discharging surface 12*a* and the recording sheet P. However, in practical use, the recording sheet P is deformed into the wave shape corrugating along the reciprocating direction, and levels of the gap between the ink discharging surface 12*a* and the recording sheet P vary depending on the position of the recording sheet P along the reciprocating direction. When the levels of the gap vary, therefore, the first and second linear patterns V1, V2 are printed in varied positions displaced from their ideal positions along the reciprocating direction. Further, while the carriage 11 is moved in one orientation to travel along the reciprocating direction to print the first linear patterns V1, the carriage 11 is moved in the other orientation, which is opposite from the one orientation, along the reciprocating direction to print the second linear patterns V2. In other words, the orientation of the carriage 11 to travel along the first direction to print the first linear patterns V1 and the orientation of the carriage 11 to travel to print the second linear patterns V2 are opposite from each other. Therefore, the first linear patterns V1 and the second linear patterns V2 printed on the wave-shaped recording sheet P are displaced in the mutually opposite orientations with respect to the ideal positions.

When the level of gap between the ink discharging surface 12*a* and the recording sheet P changes, a position of a pattern intersection, which is the intersection of the first linear pattern V1 and the second linear pattern V2 within the single unit pattern U, is displaced within the unit pattern U in the printed gap level pattern T with respect to the ideal position along the sheet-conveying direction. Accordingly, the displacement of the first and the second linear patterns V1, V2 along the reciprocating direction due to the fluctuation of levels of the gap between the ink discharging surface 12*a* and the recording sheet P appears to form moire of the pattern intersections, which fluctuate along the sheet-conveying direction. In other words, as indicated in a dashed line in FIG. 8A, the moire consisting of the pattern intersections forms a graph representing the fluctuation of levels of the gap between the ink discharging surface 12*a* and the recording sheet P at each position along the reciprocating direction while the horizontal axis and the vertical axis coincide with the reciprocating direction and the sheet-conveying direction respectively. Thus, the printed gap level pattern T exhibits the fluctuation of the gap levels between the ink discharging surface 12*a* and the recording sheet P to be detectable on the recording sheet P.

While the first and second linear patterns V1, V2 are displaced with respect to the ideal positions along the reciprocating direction, in either orientation, when the second linear pattern V2 is displaced for an amount x along the reciprocating direction with respect to the first linear pattern V1, as shown in FIG. 8C, an amount y of the displacement for the pattern intersection along the sheet-conveying direction is equal to x divided by tan θ ($y=x/\tan\theta$). Therefore, when the angle θ is smaller than 45 degrees ($\theta<45°$), and when $1/\tan\theta$ is greater than 1 ($1/\tan\theta>1$), the amount y is greater than the amount x ($y>x$), and the amount y of displacement of the pattern intersection along the sheet-conveying direction is achieved as being amplified by the amount x of relative displacement between the first and second linear patterns V1, V2. Thus, even when the amount of relative displacement between the first and second linear patterns V1, V2 is small, the amount y of displacement of the pattern intersection along the sheet-conveying direction appears to be greater.

While the positions of the printed first and second linear patterns V1, V2 are displaced from the ideal positions along the reciprocating direction on the recording sheet P, in order for the first and second linear patterns V1, V2 to intersect each other, it is necessary that the second linear pattern V2 is printed in a position between an upstream-end point, on which the upstream end of the second linear pattern V2 along the sheet-conveying direction overlaps the upstream end of the first linear pattern V1 along the sheet-conveying direction, and a downstream-end point, on which the downstream end of the second linear pattern V2 along the sheet-conveying direction overlaps the downstream end of the second linear pattern V1 along the conveying direction, i.e., between two dash-and-dot lines shown in FIG. 8B. In this respect, while the first linear pattern V1 extends in parallel with the sheet-conveying direction, a length (width) between the upstream and downstream end points of the second linear pattern V2 along the reciprocating direction is equal to the distance k1. Therefore, when the amount x of relative displacement between the first and second linear patterns V1, V2 is variable to fluctuate within a range D, it is necessary that the range D is smaller than the distance k1 ($D<k1$). Thus, when the gap level pattern T and dimensions of the components to print the gap level pattern T, including the corrugated plate 15, the ribs 16, and the corrugated spur wheels 18, 19, are designed to achieve the range D being smaller than the distance k1, the first and second linear patterns V1, V2 are printed to intersect each other. It is to be noted that, when the range D is smaller than the distance k1 ($D<k1$), and while the first inclination A1 is equal to zero ($A1=0$) and the second inclination A2 is equal to −k1 ($A2=-k1$), D is smaller than the absolute value of the second inclination A2 subtracted from the first inclination A1 ($D<|A1-A2|$).

While the second linear pattern V2 is displaced with respect to the first linear pattern V1 along the reciprocating direction within the range to intersect the first linear pattern V1, as mentioned above, the position of the second linear pattern V2 is variable with respect to the first linear pattern V1 within the area between the two (upstream and downstream) ends along the sheet-conveying direction (i.e., between the dash-and-dot lines in FIG. 8B). However, while the interval p between two neighboring unit patterns U along the reciprocating direction is greater than k1 being the distance between the two ends of the second linear pattern V2 along the reciprocating direction ($p>k1$), the second linear pattern V2 in one of the unit patterns U does not intersect the first linear pattern V1 in another one of the adjoining unit patterns U. Further, while the range D is smaller than the distance k1 ($D<k1$), the second linear pattern V2 in one of the unit patterns U always intersects the first linear pattern V1 in the same one of the unit patterns U. In other words, one unit pattern U may have one and only intersection of the first linear pattern V1 with the second linear pattern V2.

Next, following S101 in the flow shown in FIG. 6A, in S102, the gap level pattern T having been printed in S101 is read by a scanner 61 (see FIG. 5) which is separated from the printer 1. More specifically, a piece of gap level pattern T is divided along the reciprocating direction into a plurality of smaller detectable areas H. Each detectable area H includes a plurality of unit patterns U and is indicated by dash-and-two-dots lines in FIG. 8B. Further, the patterns formed in each detectable area H are read. In this respect, each detectable area H is further divided into eight (8) detectable fields G1-G8 (see FIG. 9A), and each detectable field G1-G8 is read individually.

Next, in S103, a PC 62 (see FIG. 5) connected with the scanner 61 obtains a degree of brightness in each of the detectable fields G1-G3 based on result achieved from reading of the gap level pattern T in S102.

Next, in S104, the PC 62 sets an interpolation equation C(Y) concerning positions Y of brightness B (see FIG. 9A) along the sheet-conveying direction in the detectable area H based on the degrees of brightness in the detectable fields G1-G8 obtained in S103. More specifically, in fact, the degrees of brightness obtained in S103 are not values indicating brightness in every position within the detectable area H but are values indicating average brightness, which represent the brightness in every position in each detectable field G1-G8. Accordingly, the degrees of brightness are non-continuous but discrete as indicated in circles in FIG. 9A. Therefore, in S104, the interpolation equation C(Y) concerning the positions of the degrees of brightness B along the sheet-conveying direction within the detectable area H is derived from distribution of the average degrees of brightness in the detectable fields G1-G according to, for example, a least square method.

For example, when a position Y along the sheet-conveying direction is 1 (Y=1) while brightness B is $B_1$ ($B=B_1$); when a position Y along the sheet-conveying direction is 2 (Y=2) while brightness B is $B_2$ ($B=B_2$); . . . and when a position Y along the sheet-conveying direction is 8 (Y=1) while brightness B is $B_8$ ($B=B_8$), a smallest value for "a" in $\Sigma\{Bn-C_0(n-a)\}^2$, (n=1, 2, . . . 8), should be achieved using an adequate function $C_0(Y-a)$. The value "a" may be achieved analytically or, for example, by assigning values incrementing from −8 to +8, e.g., by 0.1, to "a" and comparing results of the assignment to achieve the smallest value a' being "a" (a=a'). Thus, the interpolation function $B=C(Y)=C_0(Y-a')$, which provides a value for B even when Y is not an integer, is established. The interpolation function $B=C(Y)=C_0(Y-a)$, which gives the smallest value closest to zero for "a" in $\Sigma\{Bn-C_0(n-a)\}^2$, may be established in advance. In this respect, it is preferable that the interpolation function $B=C(Y)=C_0(Y-a)$ forms, when represented in a graph, a curve upwardly swelling and horizontally symmetrical with respect to a maximum value (e.g., a quadratic function with a quadratic term being a negative coefficient); however, the interpolation function C(Y) may be established based on results of actually measured brightness and experiments.

Next, in S105, a position of the pattern intersection is obtained from the interpolation function C(Y) set in S104. When a unit pattern U having the mutually intersecting first and second linear patterns V1, V2 is read, width of areas occupied by the first and second linear patterns V1, V2 along the reciprocating direction is smallest at the pattern intersection compared to the other areas in the unit pattern U. Therefore, when the unit pattern U is divided into the detectable fields G1-G8 and read, one of the detectable fields G1-G8 containing the pattern intersection indicates the highest degree of brightness.

In S105, therefore, a position of the highest degree of brightness along the sheet-conveying direction (i.e., a position indicated by a square shown in FIG. 9A), which is achieved from the interpolation function C(Y), is determined to be the position of the pattern intersection along the sheet-conveying direction in the detectable area H. In this respect, while the single detectable area H includes a plurality of unit patterns U, the position of the pattern intersection determined in S105 is an average position representing the plurality of positions of the pattern intersections in the unit patterns U included in the detectable area H. The average position of the plurality of positions of pattern intersections may be referred to as a representing position of pattern intersections. For example, if the degree of brightness is maximum when Y is 4.25 (Y=4.25), it can be determined that the pattern intersection is located around a position, which divides a range between a center of the detectable field G4 and a center of the detectable field G5 along the sheet-conveying direction into 1:3.

In this respect, in order to accurately detect the degree of brightness in the unit pattern U in every position along the sheet-conveying direction, it may be necessary that the scanner 61 is capable of reading an image in higher resolution than at least resolutions of the first and second linear patterns V1, V2. In the present embodiment, however, the degrees of brightness in the detectable fields G1-G8 in each detectable area H, which includes the plurality of unit patterns U, are detected and collected to achieve the representing brightness being the average degree of brightness over the plurality of unit patterns U. Therefore, it is not necessary that the degree of brightness is detected for each unit pattern U, and even if the reading resolution of the scanner 61 is lower than the resolution of the first and second linear patterns V1, V2, the position of the pattern intersection can be detected preferably.

Further, as has been mentioned above, while a second linear pattern V2 in one unit pattern U does not intersect a first linear pattern V1 in a neighboring different unit pattern U, there is no second intersection, which is second to the pattern intersection formed by the first and second linear patterns V1, V2 within the same unit pattern U, in the gap level pattern T. Thus, erroneous detection of a redundant intersection can be avoided.

Further, according to the present embodiment, after collecting the degrees of brightness in the detectable fields G1-G8, the interpolation function C(Y) for the distribution of the degrees of brightness in the detectable area H along the sheet-conveying direction is established, and the position corresponding to the maximum value in the established interpolation function is obtained. Therefore, the position of the pattern intersection can be achieved more accurately compared to that a predetermined representing position (e.g., a central position along the sheet-conveying direction) within one of the detectable fields G1-G8 indicating the highest degree of brightness is determined to be the position of the pattern intersection.

Moreover, the detectable fields G1-G8 will be described more specifically. The second linear pattern V2 formed to incline with respect to the sheet-conveying direction consists of, in an enlarged view (see FIG. 9B), a plurality of shorter segments M1-M7, which extend in parallel with the sheet-conveying direction in positions displaced from one another along the reciprocating direction. Therefore, each position of the second linear pattern V2 along the reciprocating direction with respect to the first linear pattern V1 corresponds to the positions of the segments M1-M7 along the reciprocating direction with respect to the first linear pattern V1. Accordingly, the position of the second linear pattern V2 along the reciprocating direction with respect to the first linear pattern V1 falls in one of seven (7) positions, which corresponds to the quantity of the segments M1-M7.

While the position of the second linear pattern V2 along the reciprocating direction coincides with one of the seven positions, the detectable range H is divided into the detectable fields G1-G8 of eight (8), which is greater in quantity by one than the quantity (i.e., 7) of the segments M1-M7. In this respect, each of the detectable fields G1-G8 contains at least one of the segments M1-M7 partially, and ratios of the parts of the segments M1-M7 to be contained in the respective detectable fields G1-G8 are different from one another between two adjoining segments M1-M7. For example, the detectable field G1 may contain solely a part of the segment M1, while the segment G2 may contain another part of the M1 and a part of the segment M2 in a ratio of 1:6, and the segment G3 may contain another part of the segment M2 and a part of the segment M3 in a ratio of 2:5. In this respect, the ratios of the segments to be contained in the detectable fields G1-G8 change at a constant rate by 1/7, and an average distance between the first and second linear patterns V1, V2 contained in the detectable fields G1-G8 changes at the constant rate. In order for the average distance between the first and second linear patterns V1, V2 contained in the detectable fields G1-G8 to change at a constant rate, it is necessary that the quantity of the segments in the second linear pattern V2 and the quantity of the segments in the unit pattern U are equal or that the two quantities are different by 1 (whichever may be greater).

If the quantity of the segments in the second linear pattern V2 and the quantity of the segments in the unit pattern U are different by 2 or more, the average distance between the first and second linear patterns V1, V2 contained in the detectable fields G1-G8 should not change at a constant rate. In such a case, for example, the degree of brightness detected in the detectable field G2 when the pattern intersection is located in a center of the segment G2 and the degree of brightness detected in the detectable field G3 when the pattern intersection is located in a center of the segment G3 become different. Thus, the graph shown in FIG. 9A may not coincide with the distribution of the degrees of brightness in the unit pattern U, even if the graph is shifted in parallel with the Y-axis, and the position of the pattern intersection may not be detected accurately.

In consideration of such inconvenience, according to the present embodiment, the degrees of brightness are detected in the eight detectable fields G1-G8, which are greater in quantity by one than the quantity of the segments M1-M7 (i.e., 7). Thereby, the discrete degrees of brightness detected in the detectable fields G1-G8 and the interpolation function C(Y)

of the degrees of brightness established based on the distribution of the discrete degrees of brightness, which closely reflect the actual distribution of the brightness, can be achieved.

Thus, by obtaining the position of the pattern intersection in each detectable area H, fluctuation of the positions of the pattern intersections along the reciprocating direction can be obtained.

Next, following S105, in S106, the PC 62 is connected with the intersecting position storage unit 53 to communicate, and the positions of the pattern intersections obtained in S105 are transmitted from the PC 62 and stored in the intersecting position storage unit 53. However, the connection between the PC 62 and the intersecting position storage unit 53 may be established in or anytime before S106. While the information concerning the pattern intersection for each position along the reciprocating direction is stored, the amount of displacement of ink landing position along the reciprocating direction can be calculated for each position on the recording sheet P along the reciprocating direction. Therefore, by calculating the amounts of displacement, timings to eject the ink from the inkjet head 12 toward the recording sheet P can be adjusted to absorb the displacement of ink landing positions. Accordingly, even when the amount of the gap between the recording sheet P and the inkjet head 12 fluctuate depending on the position along the reciprocating direction, an image in higher quality with a small amount of landing displacement can be printed.

Next, varied examples of the embodiment will be described. In the following examples, description of configurations similar to those described in the above embodiment will be omitted.

In the previous embodiment, the interpolation function C(Y) is achieved based on the degrees of brightness in the detectable fields G1-G8, and the positions of the maximum values in the interpolation function C(Y) are determined to be the positions of the pattern intersections. However, the positions of pattern intersections may not necessarily be obtained in the method, but may be obtained, for example, by determining a position of one of the detectable fields G1-G8 with the highest degree of brightness to be the position of the pattern intersection.

For another example, in the previous embodiment, the second linear patterns V2 inclined with respect to the sheet-conveying direction consists of seven segments M1-M7, while the detectable area H is divided into eight detectable fields G1-G8, of which quantity is greater than the quantity of segments M1-M7 by one. However, the quantities of the segments and the divided detectable fields may not be limited to seven and eight. For example, the detectable area H may be divided into seven detectable fields, of which quantity is equal to the quantity of the segments M1-M7. For another example, the detectable area H may be divided into six (6) detectable fields, of which quantity is smaller than the quantity of the segments M1-M7 by one. For another example, the detectable area H may be divided into five (5) or less quantity of detectable fields, of which quantity is smaller than the quantity of the segments M1-M7 by two (2) or more. Further, for example, the detectable area H may even be divided into nine (9) or more quantity of detectable fields, of which quantity is larger than the quantity of the segments M1-M7 by two (2) or more.

Further, the detectable area H may not even be divided into a plurality of detectable fields to be read on basis of the detectable field necessarily. Instead, for example, the detectable area H may be read continuously along the sheet-conveying direction to obtain distribution of the degrees of brightness.

Further, the position of the pattern intersection to represent the detectable area H containing the plurality of unit pattern U may not necessarily be obtained by reading the gap level pattern T on basis of the detectable area H. Instead, for example, the position of the pattern intersection in each unit pattern U may be obtained by reading the gap level pattern T on basis of the unit pattern U.

In the above embodiment, the position of the highest degree of brightness in the read unit pattern U is detected to be the position of the pattern intersection. However, the positions of the pattern intersection may be, for example, detected directly by reading the unit patterns U.

For another example, the first linear pattern V1 and the second linear pattern V2 may not necessarily be drawn to extend in parallel with the sheet-conveying direction and to incline with respect to the sheet-conveying direction respectively.

For example, as shown in a first modified example in FIG. 10A, the first linear pattern V1 may be drawn to incline with respect to the sheet-conveying direction to be closer to the left-hand side of the recording sheet P as the first linear pattern V1 extends toward the downstream side along the sheet-conveying direction. Meanwhile, the second linear pattern V2 may be drawn to incline with respect to the sheet-conveying direction to be closer to the right-hand side of the recording sheet P as the second linear pattern V2 extends toward the downstream side along the sheet-conveying direction.

For another example, as shown in a second modified example in FIG. 10B, the first linear pattern V1 may be drawn to incline with respect to the sheet-conveying direction to be closer to the right-hand side of the recording sheet P as the first linear pattern V1 extends toward the downstream side along the sheet-conveying direction. Meanwhile, the second linear pattern V2 may also be drawn to incline with respect to the sheet-conveying direction to be closer to the right-hand side of the recording sheet P as the second linear pattern V2 extends toward the downstream side along the sheet-conveying direction but at a different inclination angle from the inclination of the first linear pattern V1.

In either pattern, as the first and second linear patterns V1, V2 are displaced from the ideal positions along the reciprocating direction due to fluctuation of the gap level between the ink discharging surface 12*a* and the recording sheet, the positions of the pattern intersections are displaced from the ideal positions along the sheet-conveying direction.

In either pattern, the second linear pattern V1 may be displaced with respect to the first linear pattern V1 to an extent within an intersecting range, in which the first and second linear patterns V1, V2 can intersect each other, between the dash-and-dot lines shown in FIGS. 10A, 10B, as long as the second linear pattern V2 in a unit pattern U does not intersect the first linear pattern V1 in a neighboring unit pattern U.

In order to meet the requirement, in the first modified example, the interval p between the adjoining unit patterns U along the reciprocating direction is set to be greater than k2 plus k3 ($p>k2+k3$), when a width between the two ends of the first linear pattern V1 along the reciprocating direction is k2 and a width between the two ends of the second linear pattern V2 along the reciprocating direction is k3. In this respect, the first inclination A1 is equal to k2, and the second inclination A2 is −k3. Therefore, when p is greater than k2 plus k3 ($p>k2+k3$), p is greater than the absolute value of the first inclination Al minus the second inclination A2 ($p>|A1-A2|$).

In the second modified example, in the meantime, the interval p between the adjoining unit patterns U along the reciprocating direction is set to be greater than k5 minus k4 (p>k5−k4), when a width between the two ends of the first linear pattern V1 along the reciprocating direction is k4 and a width between the two ends of the second linear pattern V2 along the reciprocating direction is k5. In this respect, the first inclination A1 is equal to k4, and the second inclination A2 is k5. Therefore, when p is greater than k5 minus k4 (p>k5−k4), p is greater than the absolute value of the first inclination A1 minus the second inclination A2 (p>|A1−A2|).

In the above examples, in order for the first and second linear patterns V1, V2 to intersect each other within a unit pattern U, it is required that the second linear pattern V2 is located in the range between the dash-and-dot lines shown in FIGS. 10A, 10B.

Therefore, in order to meet the requirement, in the first modified example, it is necessary that the range D, in which the amount x of relative displacement between the first and second linear patterns V1, V2 is variable, is smaller than the width k2 plus k3 (D<k2+k3). In the meantime, the first inclination A1 is equal to k2 (A1=k2), and the second inclination A2 is equal to −k5. Therefore, the range D is smaller than the absolute value of the first inclination A1 minus the second inclination A2 (D<|A1−A2|).

In the second modified example, it is necessary that the range D is smaller than the width k5 minus k4 (D<k5−k4). In this respect, the first inclination A1 is equal to −k4 (A1=−k4), and the second inclination A2 is equal to −k5. Therefore, the range D is smaller than the absolute value of the first inclination A1 minus the second inclination A2 (D<|A1−A2|).

Meanwhile, the first and second linear patterns V1, V2 in the first and second modified examples may be symmetrically inverted along the reciprocating direction. The inversion of the first and second linear patterns V1, V2 merely causes the negative (−) or positive (+) sign for the value in A1-A2 to be inverted; therefore, the requirements of the interval p being greater than |A1-A2| (p>|A1-A2|) and the range D being smaller than |A1-A2| (D<|A1-A2|) remain unchanged.

In the examples described above, the interval p is required to be greater than |A1-A2| in order to avoid a second linear pattern V2 in one unit pattern U from intersecting a first unit pattern V1 in an adjoining different unit pattern U. However, the interval p may be smaller than or equal to |A1-A2| (p≤A1-A2|).

When the interval p is set to be smaller than or equal to |A1-A2| (p≤|A1-A2|), the second linear pattern V2 in one unit pattern U inevitably intersects the first linear pattern V1 in the adjoining unit pattern U. In this respect, however, the pattern intersection is formed by the first and second linear patterns V1, V2 within the one unit pattern U just as the pattern intersections described in the above embodiments. Therefore, by selecting correct patterns intersection among a plurality of intersections formed by the first linear patterns V1 and the second linear patterns V2 in the adjoining unit patterns U, the levels of the gap between the ink discharging surface 12*a* and the recording sheet P may be detected.

Further, in the examples described above, the range D, in which the amount x of relative displacement between the first and second linear patterns V1, V2 is variable, is required to be smaller than |A1-A2|(D<|A1-A2|) in order to print the first and second linear patterns V1, V2 to intersect each other within the unit pattern U. However, the range D may be greater than or equal to |A1-A2|(D≥|A1-A2|). In this regard, when the levels of the gap between the ink discharging surface 12*a* and the recording sheet P exceeds a predetermined amount, the first and the second linear patterns V1 V2 are printed in positions not to intersect each other. In such a case, the level of the gap may not be achieved, but the gap enlarged to exceed the predetermined amount can be recognized.

In the examples described above, the unit patterns U are read by the scanner 61, which is separated from the inkjet printer 1. However, the scanner 61 may not necessarily be separated from the inkjet printer 1. For example, in a third modified example shown in FIG. 11, the control device 50 is equipped with an intersecting position obtaining unit 55. In this configuration, the reading unit 5 reads the gap level pattern T, the intersecting position obtaining unit 55 obtains the positions of pattern intersections based on the read image of the gap level pattern T, and the obtained positions of the pattern intersections are stored in the intersecting position storage unit 53.

In this configuration, it is necessary that the inkjet printer 1 is equipped with the reading unit 5 to read the unit patterns U. On the other hand, in the previous examples, the gap level pattern T is read by the scanner 61 which is separated from the inkjet printer 1; therefore, the inkjet printer 1 may be a single-functioned printing apparatus without the reading unit 5.

In the examples described above, the gap level pattern T is read by the scanner 61, and the positions of the pattern intersections are obtained from the read image. However, the positions of the pattern intersections may not necessarily be obtained via the scanner 61. In the gap level pattern T, the pattern intersections form moire on the recording sheet P (see FIG. 8A), and displacement of the first and second linear patterns V1, V2 along the reciprocating direction appears to be displacement of the pattern intersections along the sheet-conveying direction in the moire.

Therefore, a worker in a factory may observe the moire appearing in the gap level pattern T and judge whether the inkjet printer 1 is correctly assembled. Further, the worker may adjust discharging timings to discharge the ink from the nozzles 10 to reduce the amounts of displacement of the ink landing positions by observing the gap level pattern T and may print the gap level pattern T once again after the adjustment. Thus, if the discharging timing is correctly adjusted, the moire may be formed linearly along the reciprocating direction, and the worker may observe the moire to verify that the ejection timing is correctly adjusted.

As indicated in the dashed line in FIG. 8A, the moire consisting of the pattern intersections forms a graph representing the fluctuation of levels of the gap between the ink discharging surface 12*a* and the recording sheet P at each position along the reciprocating direction while the horizontal axis and the vertical axis coincide with the reciprocating direction and the sheet-conveying direction respectively. Therefore, the printed gap level pattern T may effectively serve as a graph which visualizes the fluctuation of the gap level on the recording sheet P. Meanwhile, the verification may be conducted by using a reading apparatus.

In the examples described above, the recording sheet P is deformed into the wave shape along the reciprocating direction by the corrugated plate 15, the ribs 16, and other components. However, the recording sheet P may not necessarily be deformed intentionally into the wave shape but may be unintentionally bent or curved and change the level of the gap between the ink discharging surface 12*a* and the recording sheet P. Even in such unintentional cases, the level of the gap between the ink ejection surface 12*a* and the recording sheet P can be detected based on the amount of displacement of the pattern intersections along the sheet-conveying direction similarly to the methods described in the above examples.

Although examples of carrying out the invention have been described, those skilled in the art will appreciate that there are numerous variations and permutations of the printing apparatus, the gap detecting device, and the method to detect the gap level fluctuation that fall within the spirit and scope of the invention as set forth in the appended claims. It is to be understood that the subject matter defined in the appended claims is not necessarily limited to the specific features or acts described above. Rather, the specific features and acts described above are disclosed as example forms of implementing the claims.

What is claimed is:

1. An inkjet printer, comprising:

an inkjet head configured to discharge ink droplets from nozzles formed in an ink discharging surface thereof;

a head scanning unit configured to move the inkjet head facing a recording medium to reciprocate along a first direction, the first direction being parallel with the ink discharging surface of the inkjet head; and a pattern-printing control device configured to control the inkjet head and the head scanning unit to print a gap level pattern, which is configured to exhibit fluctuation of levels of a gap between the ink discharging surface and the recording medium along the first direction to be detectable, on the recording medium, wherein the pattern-printing control device controls the inkjet head and the head scanning unit to print the gap level pattern including a plurality of unit patterns, in each of which a first linear pattern and a second linear pattern intersect each other, aligned along the first direction, by:

manipulating the inkjet head to move in a first orientation along the first direction and to discharge the ink from the plurality of nozzles to form a plurality of first linear patterns, which are formed to intersect the first direction, along the first direction while being moved; and manipulating the inkjet head to move in a second orientation along the first direction and to discharge the ink from the plurality of nozzles to form a plurality of second linear patterns, which are formed to intersect the first linear patterns respectively at a same angle, along the first direction while being moved.

2. The inkjet printer according to claim 1, wherein, when a difference along the first direction between end positions of the first linear pattern within a coexisting area, in which the first linear pattern and the second linear pattern in the unit pattern coexist along a second direction being orthogonal to the first direction, is represented as a first inclination amount A1, whereas the first orientation along the first direction represents increment in positive quantity, and a difference along the first direction between end positions of the second linear pattern within the coexisting area in the unit pattern is represented as a second inclination amount A2, whereas the first orientation along the first direction represents increment in positive quantity, and when a fluctuation range of relative positions of the second linear patterns, which are formed by the inkjet head moving in the second orientation, with respect to the positions of the first linear patterns, which are formed by the inkjet head moving in the first orientation along the first direction, is represented as D, the pattern-printing control device controls the inkjet head to print the first linear patterns and the second linear patterns to satisfy an inequality of: $|A1-A2|>D$.

3. The inkjet printer according to claim 1, wherein the pattern-printing control device is configured to form the plurality of unit patterns along the first direction at a predetermined interval p; and wherein, when a difference along the first direction between end positions of the first linear pattern within a coexisting area, in which the first linear pattern and the second linear pattern in the unit pattern coexist along a second direction being orthogonal to the first direction, is represented as a first inclination amount A1, whereas the first orientation along the first direction represents increment in positive quantity, and a difference along the first direction between end positions of the second linear pattern within the coexisting area in the unit pattern is represented as a second inclination amount A2, whereas the first orientation along the first direction represents increment in positive quantity, the pattern-printing control device controls the inkjet head to print the plurality of unit patterns to satisfy an inequality of: $p>|A1-A2|$.

4. The inkjet printer according to claim 3, wherein the inkjet head comprises at least one nozzle line, in which the plurality of nozzles are arranged along the second direction;

wherein, when the pattern-printing control device controls the inkjet head to form the first linear patterns extending in parallel with the second direction and the second linear patterns to intersect the first linear patterns at an intersecting angle θ at respective midpoints of the first and second linear patterns by using the at least one nozzle line within a range of length L along the second direction, the pattern-printing control device controls the inkjet head to print the plurality of unit patterns to satisfy an inequality of: $p>L \tan \theta$.

5. The inkjet printer according to claim 1, wherein the pattern-printing control device controls the inkjet head to form the first linear patterns and the second linear patterns to intersect each other at an angle smaller than 45 degrees.

6. The inkjet printer according to claim 1, further comprising:

a wave shape generating mechanism configured to deform the recording medium into a predetermined wave shape that has tops of portions protruding toward the ink discharging surface and bottoms of portions recessed toward a side opposite from the ink discharging surface, the tops and the bottoms being alternately arranged along the first direction.

7. The inkjet printer according to claim 1, further comprising:

a reading unit configured to read the predetermined gap level pattern printed on the recording medium; and a gap level obtaining device configured to obtain the fluctuation of levels of the gap between the ink discharging surface and the recording medium along the first direction by detecting the levels of the gap between the ink discharging surface and an area on the recording medium, in which the unit patterns in the gap level pattern are formed, based on positions of intersections, in which the second linear patterns intersect the first linear patterns within the respective unit patterns, along a second direction being orthogonal to the first direction.

8. The inkjet printer according to claim 7, wherein the gap level obtaining device is configured to divide the printed gap level pattern into a plurality of detectable areas along the first direction, each of the detectable areas including the plurality of unit patterns; and wherein the gap level obtaining device is configured to detect the levels of the gap between the ink discharging surface and the detectable areas on the recording medium by obtaining positions of representing intersections, each of which represents an average position of the intersections included in the plurality of unit patterns along the second direction.

9. The inkjet printer according to claim 8, wherein a reading resolution along the first direction for the reading unit is smaller than a printing resolution along the first direction for the inkjet head to form the second linear pattern on the recording medium.

10. The inkjet printer according to claim 8, wherein the reading unit is configured to obtain distribution of degrees of brightness in each of the detectable areas in the gap level pattern printed on the recording medium; and wherein the gap level obtaining device is configured to determine a position of a maximum value in the degrees of brightness in each detectable area obtained by the reading unit to be the position of the representing intersection in the detectable area.

11. The inkjet printer according to claim 10, wherein the gap level obtaining device is configured to divide each detectable area into a plurality of detectable fields along the second direction and to detect the position of the maximum value in the degrees of brightness in each detectable area along the second direction based on degrees of brightness obtained from each of the detectable fields.

12. The inkjet printer according to claim 11, wherein the gap level obtaining device is configured to interpolate degrees of brightness in between the degrees of brightness which are discretely obtained from each of the detectable fields by using a predetermined interpolation equation and to detect the position of the maximum value along the second direction from the interpolated degrees of brightness.

13. A method to obtain fluctuation of levels of a gap between an inkjet head and a recording medium along a first direction in an inkjet printer, which comprises an inkjet head configured to discharge ink droplets from nozzles formed in an ink discharging surface thereof and a head scanning unit configured to move the inkjet head facing the recording medium to reciprocate along a first direction, the first direction being parallel with the ink discharging surface of the inkjet head, comprising steps of:

printing a gap level pattern, which is configured to exhibit fluctuation of levels of a gap between the ink discharging surface and the recording medium along the first direction to be detectable, on the recording medium;

reading the gap level pattern printed on the recording medium; and obtaining fluctuation of the levels of the gap along the first direction from the gap level pattern read in the step of reading, wherein, in the step of printing, the gap level pattern including a plurality of unit patterns, in each of which a first linear pattern and a second linear pattern intersect each other, aligned along the first direction, is printed by:

manipulating the inkjet head to move in a first orientation along the first direction and to discharge the ink from the plurality of nozzles to form a plurality of first linear patterns, which are formed to intersect the first direction, along the first direction while being moved; and manipulating the inkjet head to move in a second orientation along the first direction and to discharge the ink from the plurality of nozzles to form a plurality of second linear patterns, which are formed to intersect the first linear patterns respectively at a same angle, along the first direction while being moved, and wherein, in the step of obtaining, the fluctuation of levels of the gap between the ink discharging surface and the recording medium along the first direction is obtained by detecting the levels of the gap between the ink discharging surface and an area on the recording medium, in which the unit patterns in the gap level pattern are formed, based on positions of intersections, in which the second linear patterns intersect the first linear patterns within the respective unit patterns, along a second direction being orthogonal to the first direction.

14. A gap detectable device configured to detect fluctuation of levels of a gap between an inkjet discharging surface of an inkjet head and a recording medium along a first direction in an inkjet printer, comprising:

a reading unit configured to read a predetermined gap level pattern, which is printed in the inkjet printer on the recording medium and includes a plurality of unit patterns aligned along the first direction, each of the unit patterns including a first linear pattern formed along the first direction and a second linear pattern formed along the first direction to intersect the first linear pattern at an angle; and a gap level obtaining device configured to obtain the fluctuation of levels of the gap between the ink discharging surface and the recording medium along the first direction by detecting the levels of the gap between the ink discharging surface and an area on the recording medium, in which the unit patterns in the gap level pattern are formed, based on positions of intersections, in which the second linear patterns intersect the first linear patterns within the respective unit patterns, along a second direction being orthogonal to the first direction.

* * * * *